United States Patent [19]

Byrd et al.

[11] 4,445,465

[45] May 1, 1984

[54] SLUDGE LANCE ADVANCING APPARATUS

[75] Inventors: Audis C. Byrd; Bradley L. Todd; William W. Pattison, Jr., all of Duncan, Okla.

[73] Assignee: Halliburton Company, Duncan, Okla.

[21] Appl. No.: 478,404

[22] Filed: Mar. 24, 1983

[51] Int. Cl.[3] ..... F22B 37/52

[52] U.S. Cl. ..... 122/392; 15/316 R; 122/382

[58] Field of Search ..... 122/382, 390, 391, 392, 122/396; 15/316 R, 316 A, 317, 318

[56] References Cited

U.S. PATENT DOCUMENTS

| | | | |
|---|---|---|---|
| Re. 16,471 | 11/1926 | Bore et al. . | |
| 844,493 | 2/1907 | Bennett . | |
| 1,128,406 | 2/1915 | Burgess . | |
| 1,377,622 | 5/1921 | Kemnal et al. . | |
| 1,521,775 | 1/1925 | Liptak . | |
| 1,696,005 | 12/1928 | Kothe . | |
| 1,995,132 | 3/1935 | Snow . | |
| 2,350,929 | 6/1944 | Ridley . | |
| 2,532,447 | 12/1950 | Handoll et al. . | |
| 2,592,923 | 4/1952 | Lumb . | |
| 2,696,016 | 12/1954 | De Mart . | |
| 2,722,033 | 11/1955 | Glinn et al. . | |
| 2,992,781 | 7/1961 | Howard, Sr. . | |
| 3,104,672 | 9/1963 | Holdren . | |
| 3,311,092 | 3/1967 | McMahon et al. . | |
| 3,377,026 | 4/1968 | De Mart et al. . | |
| 3,661,124 | 5/1972 | Winkin . | |
| 3,664,310 | 5/1972 | Locke, Sr. et al. . | |
| 3,701,341 | 10/1972 | Willis, Jr. . | |
| 3,750,230 | 8/1973 | Reed . | |
| 3,816,871 | 6/1974 | Karnofsky . | |
| 3,895,465 | 7/1975 | Korn et al. . | |
| 4,079,701 | 3/1978 | Hickman et al. . | |
| 4,165,552 | 8/1979 | Johnston, Jr. . | |
| 4,177,539 | 12/1979 | Elting . | |
| 4,218,016 | 8/1980 | Freund . | |
| 4,225,362 | 9/1980 | Sentell . | |
| 4,229,854 | 10/1980 | Johnston, Jr. . | |
| 4,273,076 | 6/1981 | Lahoda et al. . | |
| 4,276,856 | 7/1981 | Dent et al. . | |
| 4,354,294 | 10/1982 | Silver | 122/392 X |

FOREIGN PATENT DOCUMENTS

| | | |
|---|---|---|
| 24530 | 1/1930 | Australia . |
| 517803 | 3/1953 | Belgium . |
| 367147 | 1/1923 | Fed. Rep. of Germany . |
| 412680 | 4/1925 | Fed. Rep. of Germany . |
| 413924 | 5/1925 | Fed. Rep. of Germany . |
| 581874 | 7/1933 | Fed. Rep. of Germany . |
| 170387 | 1/1952 | Fed. Rep. of Germany . |
| 2162500 | 12/1971 | Fed. Rep. of Germany . |
| 2162499 | 12/1971 | Fed. Rep. of Germany . |
| 145475 | 8/1978 | Fed. Rep. of Germany . |
| 137814 | 9/1979 | Fed. Rep. of Germany . |
| 1373325 | 10/1963 | France . |
| 2445487 | 12/1979 | France . |
| 44-12322 | 6/1969 | Japan . |
| 445455 | 10/1965 | Switzerland . |
| 11389 | of 1914 | United Kingdom . |
| 19270 | of 1915 | United Kingdom . |
| 14127 | of 1915 | United Kingdom . |
| 166607 | 7/1921 | United Kingdom . |
| 290131 | 5/1928 | United Kingdom . |
| 333440 | 8/1930 | United Kingdom . |
| 1029668 | 5/1966 | United Kingdom . |
| 418702 | 3/1974 | U.S.S.R. . |

*Primary Examiner*—Edward G. Favors

*Attorney, Agent, or Firm*—Lucian Wayne Beavers; James R. Duzan; Thomas R. Weaver

[57] ABSTRACT

A sludge cleaning lance advancing apparatus includes a frame having a lead screw rotatably disposed in the frame. An electric stepping motor is connected to the frame and a belt and pulley drive is connected between the stepping motor and the lead screw for rotating the lead screw upon rotation of a shaft of the stepping motor. A lance carrier has an internal screw thread engaging the lead screw, and the lance carrier and lead screw are so arranged and constructed that the lance carrier is moved longitudinally relative to the lead screw as the lead screw is rotated relative to the lance carrier. A lance is carried by the lance carrier. A handwheel is attached to the lead screw for manually rotating the lead screw to initially position the lance. An alignment rod is provided to aid in this initial positioning.

20 Claims, 13 Drawing Figures

SLUDGE LANCE ADVANCING APPARATUS

FIELD OF THE INVENTION

The present invention relates to lancing apparatus for cleaning sludge and the like from a heat exchanger.

DESCRIPTION OF THE PRIOR ART

Nuclear power plants typically utilize steam generators having a vertical inverted U-shaped tube bundle which carries the primary water directly heated by the nuclear reaction. Feedwater is carried by the shell side of the exchanger in contact with the tube bundle for generating steam to be directed to steam turbines.

Among the maintenance problems that can arise in such nuclear power plants, some of the most potentially troublesome include sludge build-up in the steam generator, and particularly relate to concentrations of sludge which may accumulate on the tube sheet at the lower end of the tube bundle.

This accumulation of sludge lowers steam production capacity, and the particles in the feedwater can cause abrasion of the U-tubes in the upper portions of the steam generator. These solids may even cause the steam turbine to foul if they are carried over in the steam. Also, since water chemistry cannot be controlled within the sludge piles, the steam generator tubes may corrode or dent.

Several problems are caused by damaged tubes. Primary water from the tube bundle may leak into the feedwater that is to be turned into steam, thus creating a safety hazard. Plugged and sleeved tubes reduce the heat transfer area of the steam generator. As more time is required to be allotted to maintenance, more radiation exposure is required for maintenance personnel. Also, the steam generator's productive life span can be decreased significantly.

Previous systems for high pressure water lancing of the spaces between the tube rows of the tube bundle of the steam generator have usually required the continuous presence of an operator at the steam generator hand holes.

The present invention provides an improved advancing apparatus for a high pressure water lance, which is particularly adapted for use in a newly developed highly automated lancing procedure developed by the assignee of the present invention.

Prior to the development of this automated sludge lancing system by the assignee of the present invention, the most commonly used system for sludge lancing of steam generators of the type used in nuclear power plants is believed to be that disclosed in U.S. Pat. No. 4,079,701 to Hickman et al. That system requires that a fluid flushing stream be continuously maintained from a pair of flushing fluid injection nozzles inserted in one hand hole of the steam generator, around the annular space between the lower shell of the steam generator and the tube bundle, to a flushing fluid suction apparatus located diametrically opposite the first hand hole at a second hand hole. While that fluid flushing stream is continuously maintained, a movable fluid lance is placed in the steam generator and moved along the tube lane to dislodge sludge deposits from between the tube rows and move the sludge outward into the annular space where it is entrained in the continuously flowing flushing fluid stream.

The advancing apparatus typically used in this prior art system is disclosed in U.S. Pat. No. 4,276,856 to Dent et al. and U.S. Pat. No. 4,273,076 to Lahoda et al.

SUMMARY OF THE INVENTION

The automated sludge lancing system developed by the assignee of the present invention operates on a substantially different principle than that described in Hickman et al., U.S. Pat. No. 4,079,701. Where the Hickman et al. system requires that a flushing stream be continuously maintained around the periphery of the tube sheet while a fluid lance is moved along the tube lane to dislodge the sludge from between the tube rows and move the sludge outward so as to be entrained in the flushing fluid stream, the system developed by the assignee of the present invention instead alternately directs the entire fluid flow first to the lance for dislodging the sludge from between the tube rows and moving it outward to the periphery of the tube bundle, and then to a flushing fluid injector which directs the entirety of the available fluid around the periphery of the tube bundle to flush the sludge which was dislodged in the previous lancing cycle. Thus, the automated system developed by the assignee of the present invention alternates between a purely lancing function and a purely flushing function, and never lances and flushes at the same time.

The present invention relates to a sludge lance advancing apparatus developed specifically for use with the automated system developed by the assignee of the present invention.

This sludge lance advancing apparatus includes a frame having a lead screw rotatably disposed in the frame. An electric stepping motor is attached to the frame and a drive means is connected between the stepping motor and the lead screw for rotating the lead screw upon rotation of a shaft of the stepping motor. A lance carrier has an internal screw thread which engages the lead screw, and the lance carrier is moved longitudinally relative to the lead screw as the lead screw is rotated relative to the lance carrier. A lance is carried by the lance carrier. A handwheel means is attached to the lead screw for manually rotating the lead screw to initially position the lance. An alignment rod is provided to aid in this initial positioning.

With this advancing apparatus, the lance is initially positioned manually by use of the handwheel so that a spray jet from the lance is directed down the first tube row to be cleaned. The controls for the stepping motor are set so as to periodically advance the lance a distance equal to the spacing between adjacent tube rows. When the lance is positioned at a given position, the system first goes through a lancing cycle during which fluid is directed to the lance for a period of time generally in the range of thirty to sixty seconds. Then, fluid flow to the lance is terminated and fluid is directed to a flushing fluid injector which then flushes the sludge dislodged during the previous lancing cycle. During the flushing cycle the lance is advanced a step to the next tube row, and then the lancing cycle and flushing cycle are repeated.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENT

Figure 1:
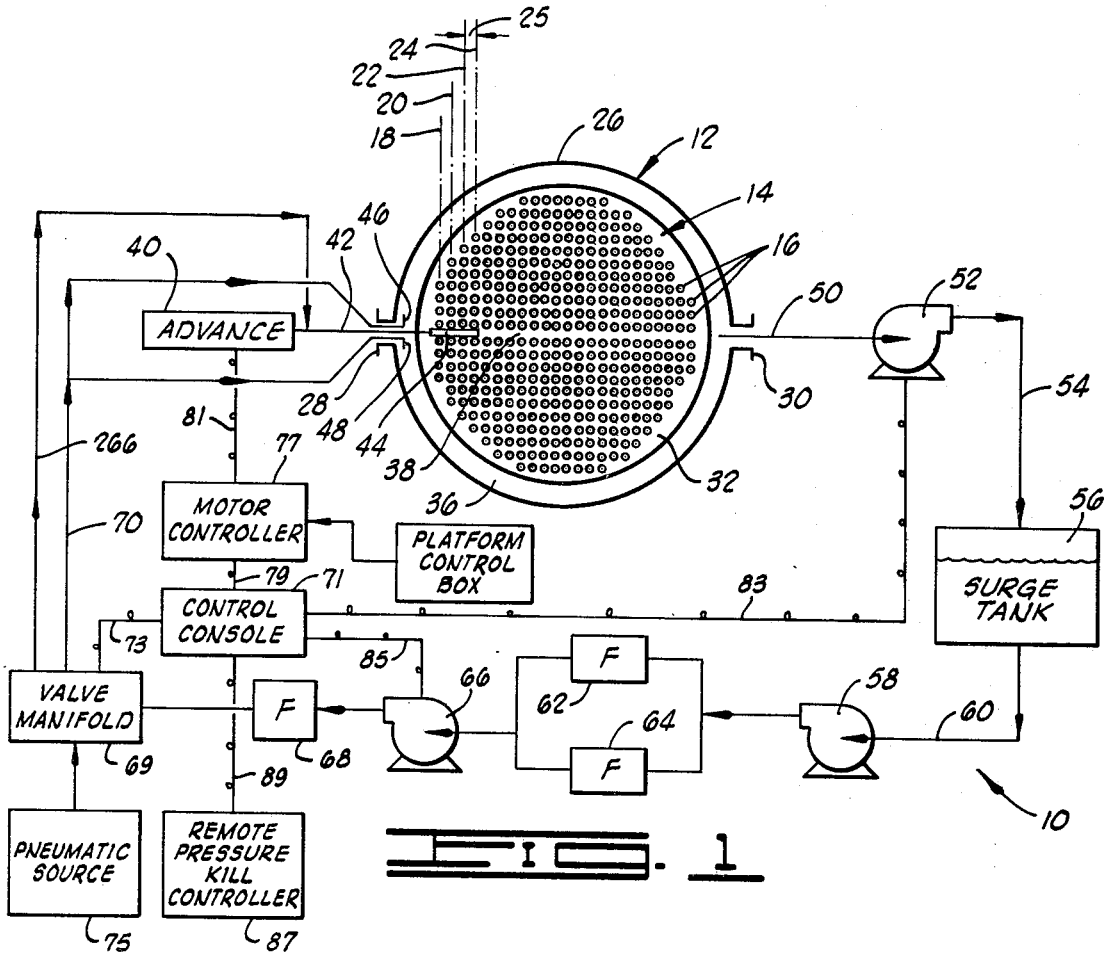
FIG. 1 is a schematic illustration of an automated sludge lancing system.

Referring now to the drawings, and particularly to FIG. 1, an automated sludge lancing system is shown schematically and generally designated by the numeral 10. Also schematically shown in horizontal cross-section is a steam generator 12 of a nuclear reactor. The steam generator 12 is of a type which is itself well known in the art such as is described, for example, in U.S. Pat. No. 4,079,701 to Hickman et al.

The steam generator 12 includes an inverted U-shaped tube bundle shown generally in cross-section and designated by the numeral 14 in FIG. 1. The tube bundle 14 includes a plurality of tubes such as designated, for example, by the numeral 16 which are arranged in a plurality of parallel, equally spaced rows.

In the following disclosure, for the purposes of illustration only, the rows of tubes 16 are designated as being the rows which are parallel to the length of the drawing sheet such as indicated by phantom lines 18, 20, 22 and 24. Those rows are equally spaced by a distance such as indicated by 25 between rows 22 and 24.

The steam generator 12 includes an outer shell 26 having a pair of flanged hand holes 28 and 30 at diametrically opposite sides thereof. The lower ends of the tubes 16 extend through a tube sheet 32. An annular space 36 is defined between tube bundle 14 and shell 26. The hand holes 28 and 30 communicate with the annular space 36 which communicates with the upper surface of tube sheet 32.

As seen in FIG. 1, at the central part of the tube bundle 14, there is a space where there are no tubes 16. This is the space between the legs of the inverted U-shaped tubes. This space defines a tube lane 38 which is diametrically aligned between the hand holes 28 and 30.

Schematically shown at the hand hole 28 is an advance mechanism 40 which advances an elongated lance arm 42 carrying a jet head 44 on its outer end through the tube lane 38.

As is described in more detail below, jets of fluid are ejected from the jet head 14 into the spaces between the tube rows such as 18, 20, 22 and 24 to remove sludge material and the like which has collected between the tubes 16 on the tube sheet 32 and to move that material outward into the annular space 36.

A pair of flushing fluid injection lines 46 and 48 are placed through hand hole 28 and are directed in opposite directions into the annular space 36.

In the operation of the system 10, the system goes through a cycle wherein it is indexed to a given position aligning the nozzles of the jet head 44 with certain spaces between the tube rows, and then fluid is directed to the jet head and directed into the spaces between the tube rows to remove sludge material from between the tube rows and push it outward into the annular space 36. This continues for a period of thirty to sixty seconds. Then, the lancing cycle stops and fluid flow to the jet head 44 is terminated. Then, a flushing cycle begins wherein flushing fluid is directed to the flushing fluid injection lines 46 and 48 and travels in two semi-circular paths through the annular space 36 to wash the sludge around to a flushing fluid suction line 50 which is disposed through the second hand hole 30. Indexing of the jet head 44 to the next adjacent space between tube rows occurs during the flushing cycle.

A suction pump 52 draws the fluid through the suction line 50 and pumps it through a discharge line 54 to a surge tank 56.

A booster pump 58 draws the fluid from surge tank 56 through line 60 and directs it through a pair of filters 62 and 64 to a pressurizer pump 66 which directs it through another filter 68 to a valve manifold 69.

A flushing fluid supply line 70 connects the valve manifold 69 to the flushing fluid injection lines 46 and 48. A lance fluid supply line 266 connects valve manifold 69 to the lance 42 and particularly to the jet head 44 for supply jetting fluid to the jet head 44.

The valve manifold 69 operates to alternately direct fluid from the pressurizer pump 66 to either the flushing fluid injection lines 46 and 48 or the jet head 44.

Valve manifold 69 is operated by powered operators (not shown) which operate in response to control signals which are sent from control console 71 through electrical connecting line 73. Power is supplied to the operators of valve manifold 69 from pneumatic power source 75.

The control console 71 also controls advance mechanism 40, suction pump 52, and pressurizer pump 66.

Control console 71 is connected to a motor controller 77 by electrical connecting means 79. Motor controller 77 is connected to the stepping motor 76 (see FIG. 2) of advance mechanism 40 by electrical connecting means 81.

Control console 71 is connected to suction pump 52 and pressurizer pump 66 by electrical connecting means 83 and 85, respectively, which carry signals to appropriate control devices (not shown) attached to the suction pump 52 and pressurizer pump 66.

Also, due to the somewhat hazardous nature of working with a steam generator for a nuclear power plant, a remote pressure kill controller 87 is preferably provided at a remote location from the control console 71 and connected thereto by electrical connecting line 89.

In operation of the system 10, the time for the jetting cycle and the time for the flushing cycle are set by controls located on the control console 71. During the flushing cycle, a signal is sent from control console 71 to motor controller 77, and it is the motor controller 77 which controls the amount by which the stepping motor 76 advances the jet head 44. In the event of an emergency, the pumps of system 10 may be shut down by actuating the remote pressure kill controller 87.

The system 10 can also include a second advancing mechanism placed in the second hand hole 30. Typically, one advance mechanism will be extended only to approximately the center of the tube lane 38 so that it cleans one-half the tube rows. Then either that same advance mechanism will be moved to the second hand hole 30, or a second advance mechanism located at the hand hole 30 will be utilized. Although the disclosure of the present application describes the advance mechanism 40 as beginning near the hand hole 28 and then advancing forward towards the center of the tube lane 38, different cleaning patterns can be utilized which may, for example, begin at the center of the tube lane 38 and move outward to the hand hole 28, or may include any combination of movements which may transverse the tube lane 38 several times for complete cleaning.

Figure 2:
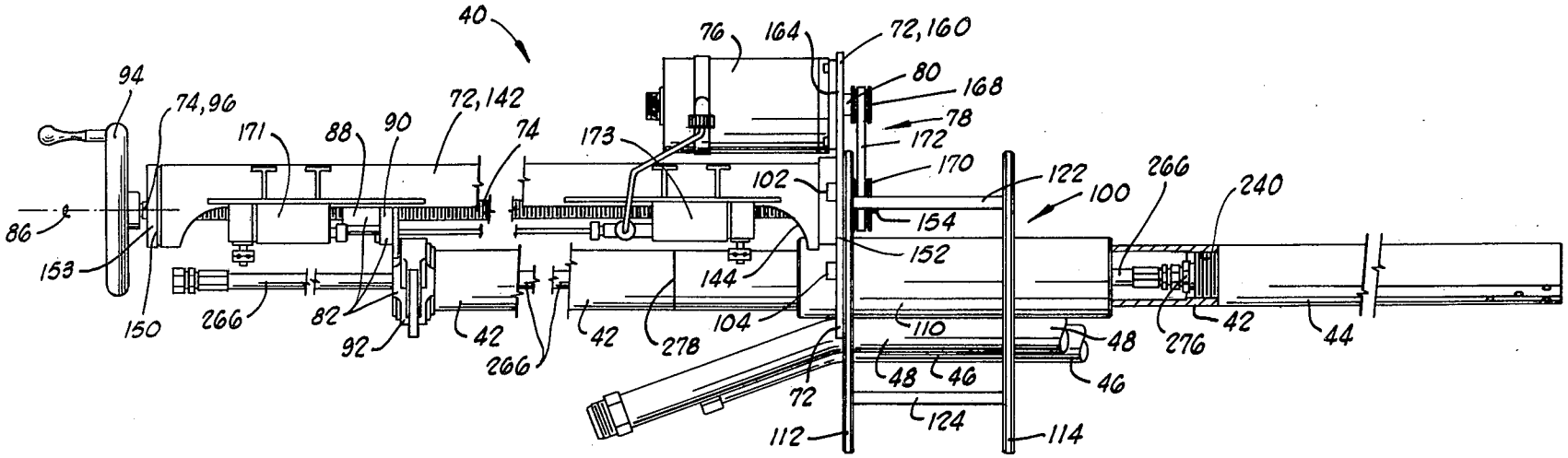
FIG. 2 is a side elevation view of the advancing apparatus, sludge lance and jet head of the system of FIG. 1.

Referring now to FIG. 2, a side elevation view is there shown of the advancing mechanism 40, elongated lance arm 42, and jet head 44.

The advancing apparatus 40 includes a frame 72. A lead screw 74 is rotatably disposed in the frame 72.

An electric stepping motor 76 is connected to the frame 72.

Drive means 78 is connected between the stepping motor 76 and the lead screw 74 for rotating the lead screw 74 upon rotation of a shaft 80 of the stepping motor 76.

A lance carrier 82 has an internal screw thread 84 (see FIG. 3) engaging lead screw 74. The lance carrier 82 and lead screw 74 are so arranged and constructed that the lance carrier 82 is moved longitudinally relative to the lead screw 74 as the lead screw 74 is rotated relative to the lance carrier 82.

In the following disclosure when it is indicated that the lance carrier 82 moves longitudinally relative to the lead screw 74, this refers to movement in a direction substantially parallel to a longitudinal axis 86 of lead screw 74.

Generally in the following disclosure, when the term longitudinal is used with regard to any particular component of the apparatus, which component has an elongated shape, the term refers to distances, directions or motion in a direction substantially parallel to a central axis which lies along the length of the elongated article.

The elongated lance arm 42 which may also generally be referred to as lance 42 is carried by the lance carrier 82. The lance carrier 82 includes an arbor 88 which contains the internal thread 84, a flange 90 attached to the arbor 88, and a releasable clamp 92 which tightly grasps the outer surface of cylindrical lance 42 so as to hold the lance 42.

The releasable clamp 92 includes a semi-circular upper part 93 which is pivotally attached to a semi-circular lower part 95 at pivot pin 97. The upper and lower parts 93 and 95 are releasably held together by a hand-actuated lever 99.

Figure 3:
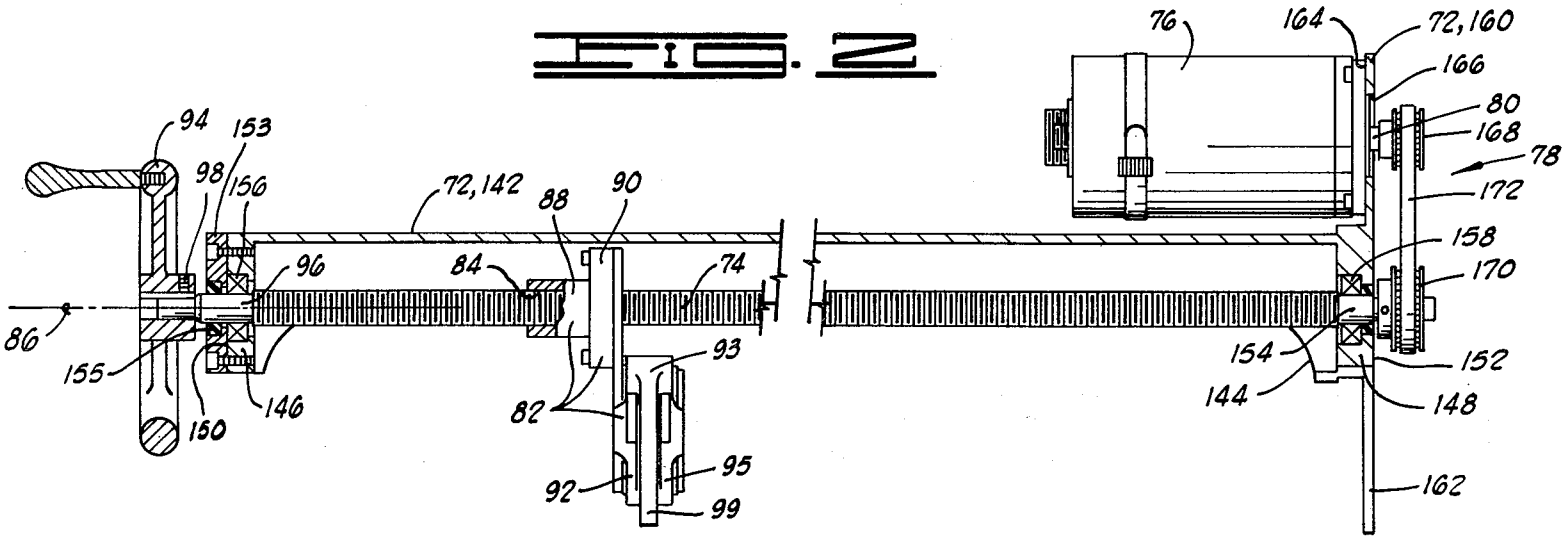
FIG. 3 is a side elevation section view of a portion of the advancing apparatus of FIG. 2.

A handwheel means 94 is attached to an end shaft 96 of lead screw 74 and held in place thereon by a set screw 98 (see FIG. 3).

The advance mechanism 40 also includes a holder means 100 which is attached to the frame 72 by cap screws, such as 102 and 104, for slidably receiving a portion of the lance 42 which is located forward of the lance carrier 82. In FIG. 2, the right-hand side of the figure is generally referred to as the forward direction and the left-hand side is generally referred to as the rearward direction.

Figure 7:
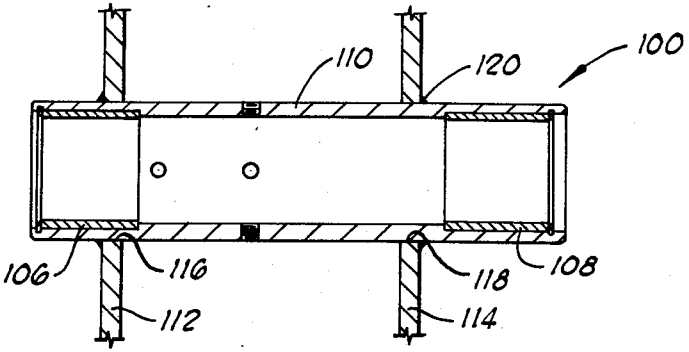
FIG. 7 is a section view taken along lines 7—7 of FIG. 6.
Figure 6:
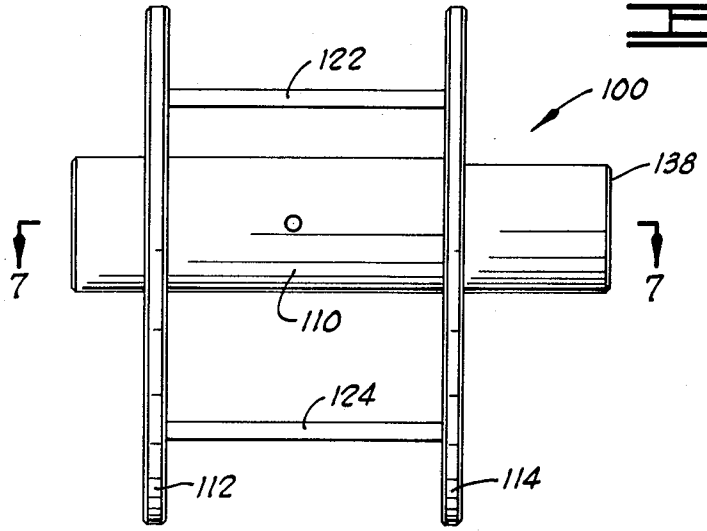
FIG. 6 is a side elevation view of the holder means of FIG. 2.
Figure 8:
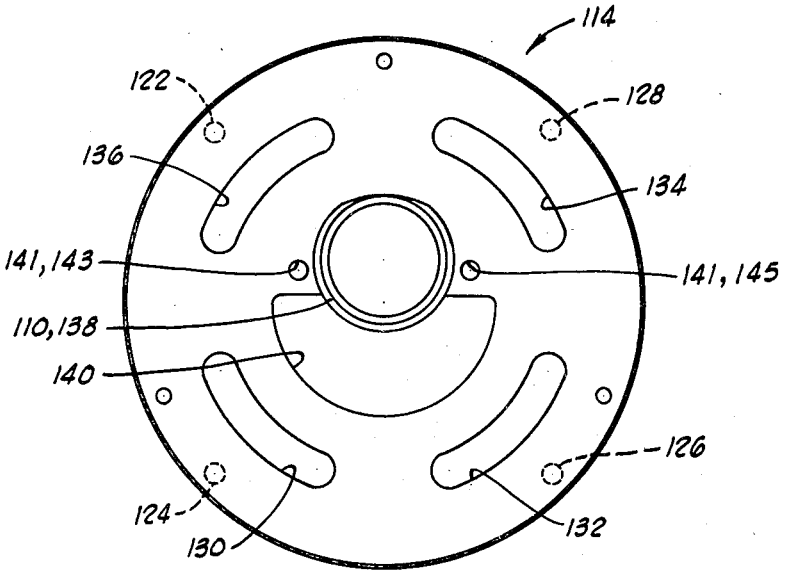
FIG. 8 is a right-end elevation view of the apparatus of FIG. 6.

The holder means 100 is best illustrated in FIGS. 6–8.

As seen in FIG. 7, the holder means 100 includes a pair of longitudinally spaced bearings 106 and 108 which are slidably engaged by the lance 42.

The bearings 106 and 108 are disposed in a holder tube 110. The holder means 100 further includes first and second spaced plates 112 and 114 which respectively include first and second aligned holes 116 and 118 through which the holder tube 110 is disposed. Holder tube 110 is attached to the plate 112 such as by welding as indicated, for example, at 120 in FIG. 7. Four spacer bars 122, 124, 126 and 128 are located between and attached to the plates 112 and 114 to hold them in position relative to each other.

The frame 72 is attached to the plate 112 by the previously mentioned cap screws such as 102 and 104 as seen in FIG. 2.

The second plate 114 is best seen in an end elevation view in FIG. 8. Second plate 114 is adapted to be attached to the flange of flanged hand hole 28 (see FIG. 1). Hand hole 28 may also be described as an access opening of the heat exchanger 12.

As seen in FIG. 8, plate 114 has four elongated, partially circumferentially slots 130, 132, 134 and 136 disposed therethrough and located at angles of 90° about the center of plate 114. The slots 130, 132, 134 and 136 permit the plate 114 to be bolted to the flange of flanged hand hole 28 such that a forward end 138 of holder tube 110 extends through the flanged hand hole 28.

Second plate 114 includes an injection line passageway opening 140 which is aligned with a similar injection line passageway opening of first plate 112. The injection line passageway openings such as 140 permit the fluid flushing injection lines 46 and 48 to be placed therethrough and inserted through the manhole 28 as illustrated in FIG. 2.

The holder means 100 also includes alignment rod opening means 141. As is seen in FIG. 8, the second plate 114 includes first and second rod openings 143 and 145. The first plate 112 includes similar rod openings which are longitudinally aligned with the rod openings 143 and 145. These rod openings are for use with an alignment rod 147, see FIG. 14, the function of which is further described below.

Referring now to FIGS. 2, 3, 4 and 5, the frame 72 includes a tubular frame portion 142 having an elongated lance carrier opening 144 disposed in a radial wall thereof. The carrier opening 144 is elongated parallel to the longitudinal axis 86 of the lead screw 74 and tubular frame portion 142. Tubular frame portion 142 includes closed first and second end walls 146 and 148 located at first and second ends 150 and 152, respectively, of tubular portion 142, as best seen in FIG. 3.

A seal container plate 153 is bolted to first end wall 146 and includes a shaft seal 155.

The lead screw 74 has its first end shaft 96 and a second end shaft 154 disposed through and rotatably received in first and second end walls 146 and 148, respectively, of tubular frame portion 142. The end shafts 96 and 154 are journaled in the first and second end walls 146 and 148 by bearings 156 and 158, respectively.

The releasable clamp 92 of lance carrier 82 extends radially from lead screw 74 through the carrier opening 144 of tubular frame portion 142 of frame 72.

Figure 4:
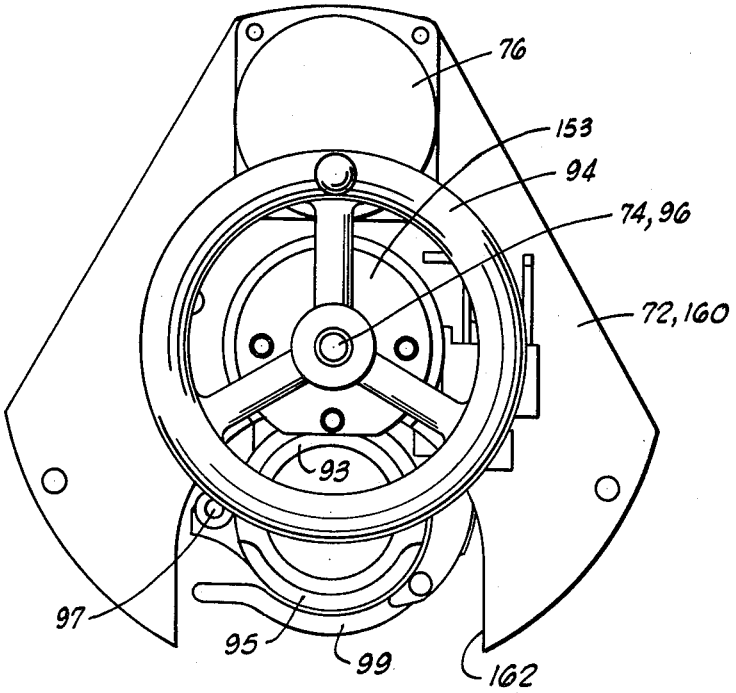
FIG. 4 is a left-end elevation view of the apparatus of FIG. 3.

The frame 72 further includes a plate portion 160 extending radially outward from second end wall 148 as best seen in FIG. 4 which shows the plate portion 160 in end profile. As best seen in FIG. 4, the plate portion 160 has a lance opening 162 disposed in the lower portion thereof, said lance opening 162 being aligned between the releasable clamp 92 of lance carrier 82 and the holder tube 110 of holder means 100.

The tubular portion 142 and the plate portion 162 may be constructed integrally as shown, or may be constructed from separate parts such as a piece of tubing and a piece of plate which are welded together or otherwise attached together.

The stepping motor 76 is mounted on a rearward side 164 of an upper part of plate portion 160 with the shaft 80 of stepping motor 76 oriented substantially parallel to the lead screw 74 and extending forward through an opening 166 (see FIG. 3) of plate portion 160 of frame 72.

The drive means 78 includes a first pulley 168 attached to shaft 80 of stepping motor 76. It also includes a second pulley 170 attached to second end shaft 154 of lead screw 74. The drive means 78 also includes a drive belt 172 which engages the first and second pulleys 168 and 170. Preferably, the drive belt 172 is a toothed drive belt and the pulleys 168 and 170 are toothed pulleys so that a positive drive is provided between stepping motor 76 and lead screw 74 thus preventing any slippage of stepping motor 76 relative to lead screw 74.

Figure 5:
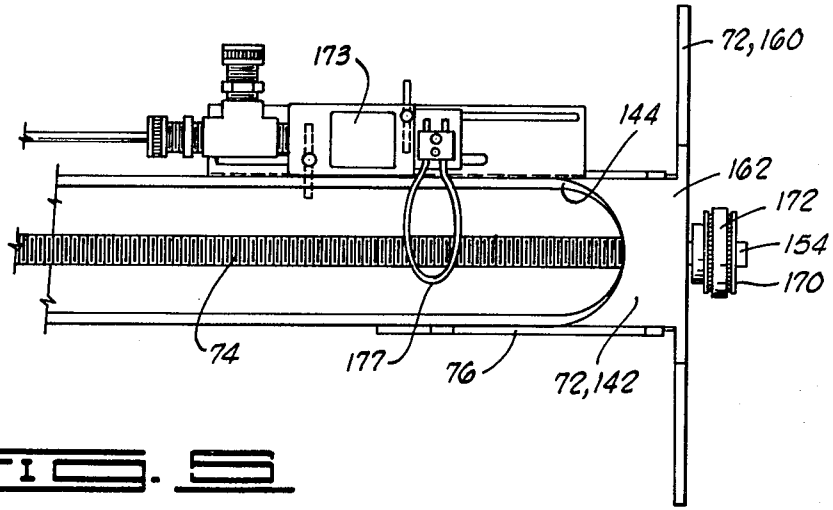
FIG. 5 is a bottom view of the apparatus of FIG. 3.
Figure 5:
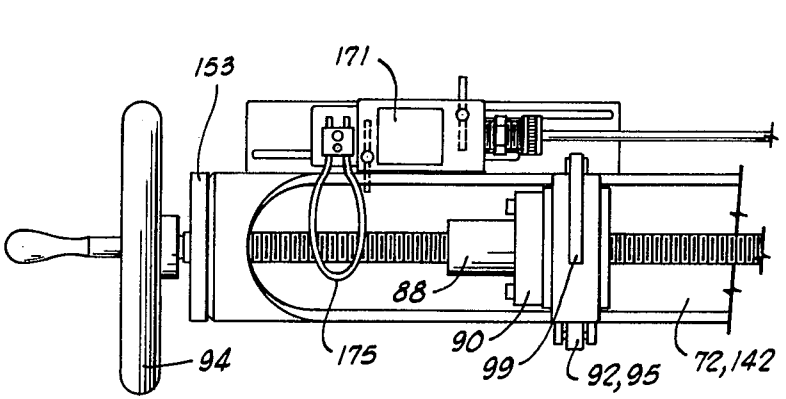

Also seen in FIGS. 2 and 5 are limit switches 171 and 173 which limit the forwardmost and rearwardmost extremities of movement of lance 42, by shutting off motor 76 when lance carrier 82 engages sensors 175 or 177 of limit switches 171 and 173.

The jet head 44 which is shown in FIG. 2 as attached to the lance 42, is itself best illustrated in FIGS. 9–13.

Figure 9:
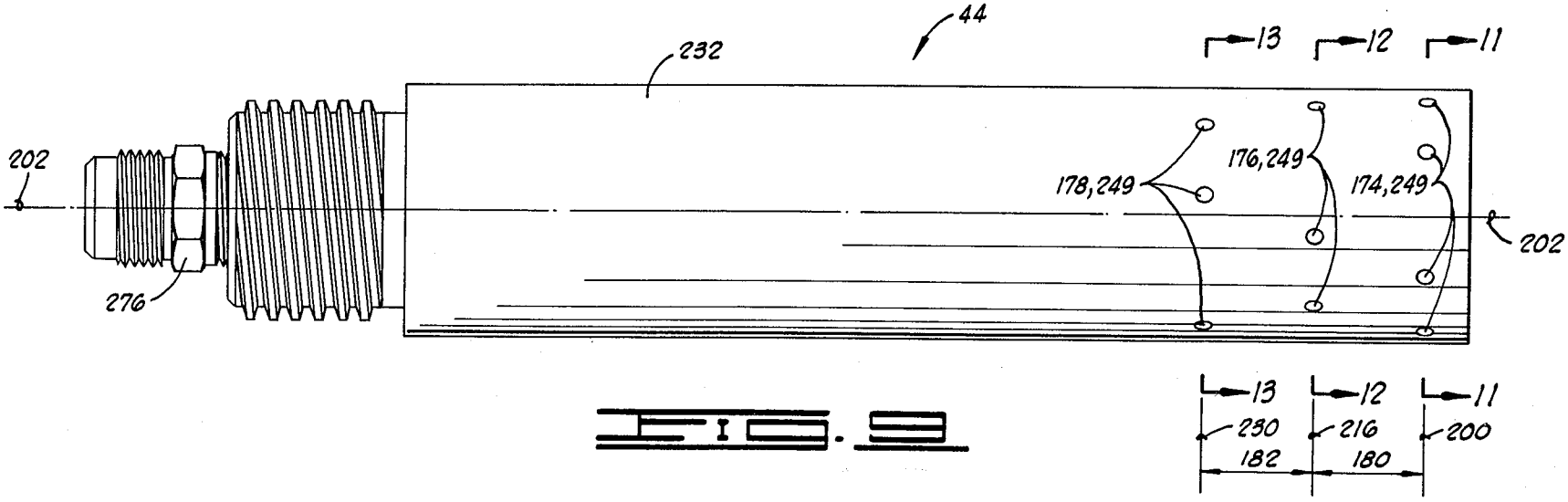
FIG. 9 is a bottom view of the jet head of the apparatus of FIG. 2, with a hose adapter connected thereto.

Referring to FIG. 9, which is a bottom view of jet head 44, the jet head 44 includes first, second and third longitudinally spaced transversely directed nozzle means 174, 176 and 178. A longitudinal distance 180 between first and second nozzle means 174 and 176 is equal to the spacing 25 between the parallel, equally spaced rows of tubes 16 of the tube bundle 14 shown in FIG. 1.

Third nozzle means 178 is spaced from second nozzle means 176 on a side of second nozzle means 176 opposite first nozzle means 174 by a longitudinal distance 182. The distances 182 and 180 are equal.

Figure 11:
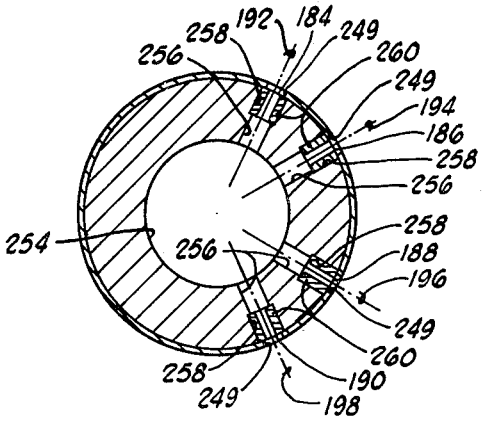
FIG. 11 is a section view along line 11—11 of FIG. 9.

The first nozzle means 174, best seen in FIG. 11, includes a first plurality of jet openings 184, 186, 188 and 190 having central axes such as 192, 194, 196 and 198 thereof lying in a first plane 200 transverse to a longitudinal axis 202 of jet head 44.

It will be appreciated that the first plane 200 in the embodiment illustrated in FIGS. 9 and 11 is perpendicular to the longitudinal axis 202 and thus is seen only as a vertical line in FIG. 9.

By describing the plane 200 as transverse to the longitudinal axis 202, it is meant only that the plane 200 is not parallel to the longitudinal axis 202. Thus, a plane which is transverse to axis 202 is not necessarily perpendicular to axis 202, although it may be.

Similarly, the second nozzle means 176 includes a plurality of jet openings 204, 206 and 208 having central axes 210, 212 and 214 which lie in a second plane 216 transverse to the longitudinal axis 202 of jet head 44.

The third nozzle means 178 includes a third plurality of jet openings 218, 220 and 222 having axes 224, 226 and 228 which lie in a third plane 230 transverse to the longitudinal axis 202 of jet head 44.

The first, second and third planes 200, 216 and 230 are parallel to each other. While they are illustrated in the present disclosure as also all being perpendicular to the longitudinal axis of jet head 44, the significance of that orientation lies in the fact that they are located parallel to the spaces between the tube rows such as 18, 20, 22 and 24 of tube bundle 14. It will be understood by those skilled in the art that many times the tubes of a tube bundle are oriented such that the bundle has rows which are oriented at an angle of other than 90° to the tube lane 38 and in such a situation the jet head 44 would be modified so that the axes of the jet openings lie in planes which are parallel to the spaces between the tube rows in the particular tube bundle which is being cleaned. Thus, while the planes 200, 216 and 230 will always be transverse to the longitudinal axis 202 of jet head 44, they will not necessarily always be perpendicular to the longitudinal axis 202.

It will be appreciated that as the advance mechanism 40 stepwise advances the jet head 44 down the tube lane 38, the space between each adjacent pair of tube rows will be lanced by fluid jets three times. Assuming that the jet head 44 is initially located near the hand hole 28 and then is advanced forward toward the center of the tube bundle 14, any given space between adjacent tube rows will first be cleaned by first nozzle means 174, then by second nozzle means 176, and then by third nozzle means 178.

It is particularly significant that when each space is cleaned by the second nozzle means 176, the fluid flow from the first and third nozzle means 174 and 178 prevents the sludge from the space being cleaned by second nozzle means 176 from dispersing into either of the adjacent spaces.

Preferably, the jet openings of each of the three nozzle means are oriented at different angles about the longitudinal axis 202 of jet head 44 so that the fluid jets ejected therefrom follow different paths through the space between adjacent tube rows so as to more thoroughly clean that space than would be the case if the jet openings of each nozzle means were longitudinally aligned. Thus, in a preferred embodiment of the invention, each of the jet openings is angularly oriented differently from any of the other jet openings of any of the three nozzle means. This is readily seen by viewing FIGS. 9 and 11-13. The particular angle of orientation of the nozzles will depend upon the dimensions of the particular steam generator involved and the vertical location of the jet head 44 above the tube sheet 34. The desired end result is, of course, to distribute the jets of fluid as uniformly as possible across the sludge material which is being removed.

This provision of multiple nozzle means and the orientation of each of the nozzle means at different angles eliminates any need for oscillating the lance about its longitudinal axis. Many prior art devices, such as shown for example in U.S. Pat. No. 4,079,701, have oscillated the lance in order to completely cover the spaces to be cleaned with the fluid jet.

Furthermore, the fluid jets exiting the jet head 44 are oriented so as to minimize and substantially eliminate any impingement upon the tubes 16 which would cause erosion of the tubes.

The jet head 44 includes a cylindrical tubular outer casing 232 which has a rear adapter 234 welded to its rear end as by weld 236. The adapter 234 has an external thread 238 which threadedly engages an internal thread 240 (see FIG. 2) of lance 42.

The casing 232 has a cylindrical inner bore 242 having a forward portion 244, a first reduced diameter middle portion 246 and a rearward further reduced diameter portion 248.

The outer casing 232 has a plurality of openings 249 disposed through a wall thereof and communicated with the forward portion 244 of inner bore 242. One of the openings 249 corresponds to each of the jet openings of the first, second and third nozzle means 174, 176 and 178.

Jet head 44 further includes a nozzle insert holder 250 having a cylindrical outer surface 252 closely received within forward portion 244 of inner bore 242 of casing 232. Insert holder 250 is held in place within casing 232 by back weld 253.

Figure 12:
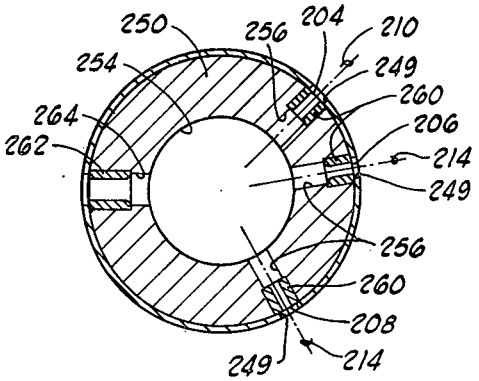
FIG. 12 is a section view taken along line 12—12 of FIG. 9.
Figure 13:
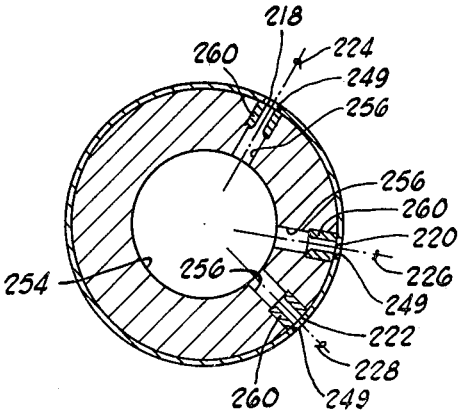
FIG. 13 is a section view taken along line 13—13 of FIG. 9.

Nozzle insert holder 250 includes a central fluid passageway 254 and a plurality of transverse bores 256 (see FIGS. 11–13). There is one transverse bore 256 for each of the jet openings of the first, second and third nozzle means 174, 176 and 178. The transverse bores 256 each communicate the fluids passageway 254 with one of the openings 249 of outer casing 232.

Each of the transverse bores 256 includes an enlarged diameter radially outer portion 258, designated as for example in FIG. 11, within which is received a nozzle insert 260 which is held in place within the enlarged diameter part 258 of transverse bore 256 by the outer casing 232 of jet head 44.

The basic design criterion for the nozzle inserts 260 is to obtain a flow of 150 gallons per minute at a pressure of 1300 psi. If a particular job is performed at higher or lower pressure, the flow rates will vary with pressure.

The first nozzle means 174 includes all of the nozzle inserts 260 shown in FIG. 11. The second nozzle means 176 includes all of the nozzle inserts 260 shown in FIG. 12. The third nozzle means 178 includes all of the nozzle inserts 260 shown in FIG. 13.

Figure 10:
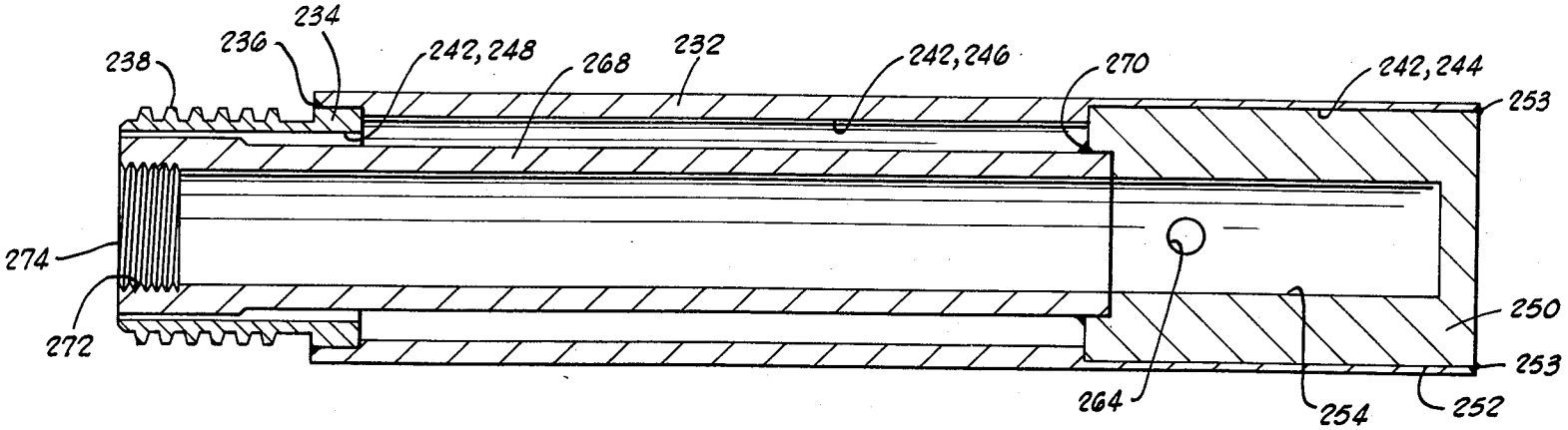
FIG. 10 is an upward facing longitudinal section view of the jet head of the apparatus of FIG. 2.

As seen in FIGS. 10 and 12, a balancing nozzle insert 262 is located in a transverse bore 264 disposed through nozzle insert holder 250 for directing a jet of fluid vertically upward in a direction 180° opposed to the combined resultant of all of the fluid jets ejected from the first, second and third nozzle means 174, 176 and 178 so as to balance the jet forces on the jet head 44.

A flow tube 268 is attached to nozzle insert holder 250 by welding as at 270 and has an internal thread 272 at its rearward end 274 within which is received a threaded adapter 276 (see FIG. 9) which is to be threadedly connected to a fluid lance supply line 266 (see FIG. 2).

Figure 14:
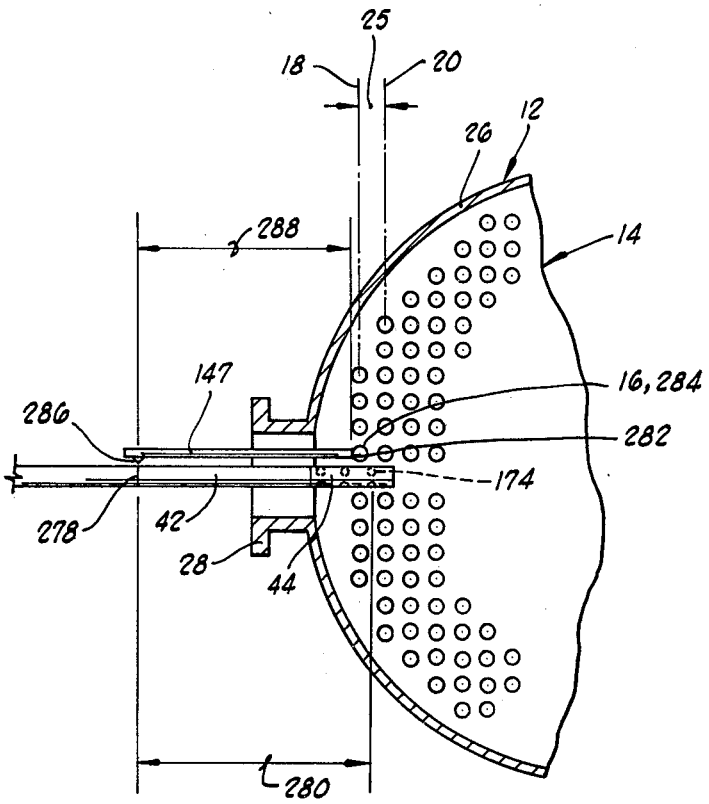
FIG. 14 is a plan schematic section view illustrating the manner in which the alignment rod is used to initially position the lance.

Referring now to FIGS. 1 and 14, the manner in which the jet head 44 of lance 42 is initially positioned relative to the tube bundle 14, and the subsequent manner of operation of the system 10 will be described.

The initial alignment of jet head 44 is best illustrated schematically in FIG. 14.

The lance 42 has a scribe mark 278, which may also be described as a first indicia means 278, thereon for identifying a point on lance 42 spaced by a first predetermined longitudinal distance 280 from first nozzle means 174.

The alignment rod 147 is placed through aligned rod openings such as the openings 145, see FIG. 8, so that it is held in a substantially parallel relationship to lance 42. Alignment rod 147 is moved forward until its first end means 282 abuts tube 16, 284 of a predetermined row, preferably first row 18, of the plurality of parallel rows of tubes of the tube bundle 14.

The alignment rod 147 has a pointer 286, which may also be referred to as a second indicia means 286, thereon for identifying a point on alignment rod 147 spaced by a second predetermined longitudinal distance 288 from first end means 282 of alignment rod 147.

The lance 42, including the jet head 44, and the alignment rod 147 are so arranged and constructed that when the first end means 282 of alignment rod 147 is abutted against tube 16, 284 of first row 18, and when the first indicia means 278 of lance 42 is aligned with the second indicia means 286 of alignment rod 147, the first nozzle means 174 of jet head 44 is aligned with a predetermined space between adjacent tube rows of the tube bundle 14, namely the space between first and second rows 18 and 20.

The first tube row 18 may also be referred to as an outermost row of tubes. Thus, the predetermined space between adjacent tube rows into which first nozzle means 174 is initially directed is the space between the outermost row of tubes 18 and the adjacent row of tubes 20.

The first predetermined distance 280 exceeds the second predetermined distance 288 by a distance equal to the sum of one-half the diameter of one of the tubes 16 plus one-half the spacing 25 between tube rows.

Thus, FIG. 14 illustrates a preferred initial position of the jet head 44.

After that initial positioning, the controls on control console 71 and motor controller 77 are set so as to control the time for the jetting and flushing cycles and so as to control the stepwise advance of advancing apparatus 40 so that with each step it moves forward by the distance 25 equal to the tube row spacing.

As the jet head 44 advances down the tube lane 38, each space between adjacent tube rows will be cleaned three times.

For example, when jet head 44 has advanced to the position shown in FIG. 1, first nozzle means 174 is directed into a first space between tube rows 24 and 22, and the second nozzle means 176 would correspondingly be directed into a second space between tube row 22 and adjacent tube row 20.

With the jet head 44 so positioned, fluid is directed to the jet head 44 through the lancing fluid supply line 266 and fluid exits the first, second and third nozzle means 174, 176 and 178. The fluid from first nozzle means 174 is directed into the first space between tube rows 24 and 22, and the second nozzle means 176 is directed into the second space between tube rows 22 and 20. This cleans the sludge from those first and second spaces.

Then, the lancing fluid is stopped and fluid is directed to the flushing injectors 46 and 48 for a period of time to flush the annular space 36 and remove the material previously cleaned from between the tube rows.

During the flushing cycle, the jet head 44 is advanced relative to the heat exchanger 12 to a second position which is located forward by the distance 25 which is the spacing between tube rows, and the first nozzle means 174 is directed into a space adjacent tube row 24 on a side thereof opposite the space between tube rows 22 and 24.

Then the lancing cycle is repeated by ejecting fluid from the nozzles of the jet head 44 while the jet head 44 is located at this second position. Thus sludge is again cleaned from the space between tube rows 22 and 24, this time by the second nozzle means 176.

Similarly, when jet head 44 is again advanced, the space between tube rows 22 and 24 will be cleaned for a third time by the third nozzle means 178.

With the preferred embodiment illustrated in FIGS. 9 and 11–13, each of the nozzle means will direct fluid into the spaces between the tube rows at different angles, which angles are chosen to provide uniform cleaning along the entire length of the space between tube rows.

Thus it is seen that the apparatus and methods of the present invention readily achieve the ends and advantages mentioned as well as those inherent therein.

What is claimed is:

1. A sludge cleaning lance advancing apparatus, comprising:

a frame;

a lead screw rotatably disposed in said frame;

an electric stepping motor connected to said frame;

drive means, connected between said stepping motor and said lead screw, for rotating said lead screw upon rotation of a shaft of said stepping motor;

a lance carrier having an internal screw thread engaging said lead screw, said lance carrier and said lead screw being so arranged and constructed that said lance carrier is moved longitudinally relative to said lead screw as said lead screw is rotated relative to said lance carrier;

a lance, carried by said lance carrier; and a hand wheel means attached to said lead screw, for manually rotating said lead screw to initially position said lance.

2. The apparatus of claim 1, further comprising:

holder means, attached to said frame, for slidably receiving a portion of said lance forward of said lance carrier.

3. The apparatus of claim 2, wherein said holder means includes a pair of longitudinally spaced bearings which are slidably engaged by said lance.

4. The apparatus of claim 3, wherein said holder means further includes:

a holder tube having said pair of bearings disposed therein;

first and second spaced plates having said holder tube disposed through first and second aligned holes disposed in said first and second plates, respectively, said holder tube being attached to said first and second plates; and wherein said frame is attached to said first plate.

5. The apparatus of claim 4, wherein:

said second plate is adapted to be attached to a flange of an access opening of a heat exchanger.

6. The apparatus of claim 4, wherein:

said first plate includes a first flushing line passageway opening aligned with a second flushing line passageway opening of said second plate.

7. The apparatus of claim 2, wherein:

said frame includes a tubular frame portion having a carrier opening disposed in a radial wall thereof, said carrier opening being elongated parallel to a longitudinal axis of said tubular frame portion, and having closed first and second end walls at first and second ends, respectively, of said tubular frame portion.

8. The apparatus of claim 7, wherein:

said lead screw has first and second end shafts disposed through and rotatably received in said first and second end walls, respectively, of said tubular frame portion; and said lance carrier extends through said carrier opening of said tubular frame portion.

9. The apparatus of claim 8, wherein:

said frame includes a plate portion extending radially from said second end wall, said plate portion having a lance opening disposed therein, said lance opening being aligned between said lance carrier and said holder means.

10. The apparatus of claim 1, wherein:

said frame includes a tubular frame portion having a carrier opening disposed in a radial wall thereof, said carrier opening being elongated parallel to a longitudinal axis of said tubular frame portion, and having closed first and second end walls at first and second ends, respectively, of said tubular frame portion.

11. The apparatus of claim 10, wherein:

said lead screw has first and second end shafts disposed through and rotatably received in said first and second end walls, respectively, of said tubular frame portion; and said lance carrier extends through said carrier opening of said tubular frame portion.

12. The apparatus of claim 10, wherein:

said frame includes a plate portion extending radially from said second end wall; and said stepping motor is mounted on a rearward side of said plate portion with a shaft of said stepping motor oriented substantially parallel to said lead screw and extending forward through said plate portion.

13. The apparatus of claim 12, wherein said drive means includes:

a first pulley attached to said shaft of said stepping motor;

a second pulley attached to said second end shaft of said lead screw; and a drive belt engaging said first and second pulleys.

14. The apparatus of claim 1, wherein:

said drive means is a belt and pulley drive means.

15. The apparatus of claim 1, wherein:

said lance carrier includes a releasable clamp for releasably engaging an outer cylindrical surface of said lance.

16. The apparatus of claim 1, being further characterized as an apparatus for cleaning sludge from between tubes of a tube bundle of a heat exchanger, said tubes being arranged in a plurality of parallel equally spaced rows, wherein:

said lance includes a jet head including first and second longitudinally spaced transversely directed nozzle means, a longitudinal distance between said first and second nozzle means being equal to a spacing between said parallel equally spaced rows of said tube bundle.

17. The apparatus of claim 1, being further characterized as an apparatus for cleaning sludge from between tubes of a tube bundle of a heat exchanger, said tubes being arranged in a plurality of parallel equally spaced rows, wherein:

said lance further includes first indicia means thereon for identifying a point on said lance spaced by a first predetermined longitudinal distance from said nozzle means;

said apparatus further includes an alignment rod, having a first end means for abutting a tube of a predetermined row of said plurality of parallel rows of tubes of said tube bundle, and having a second indicia means thereon for identifying a point on said alignment rod spaced by a second predetermined longitudinal distance from said first end means; and said lance and alignment rod are so arranged and constructed that when said first end means of said alignment rod is abutted against said tube of said predetermined row, and when said first indicia means of said lance is aligned with said second indicia means of said alignment rod by rotation of said handwheel means, said nozzle means of said jet head is aligned with a predetermined space between adjacent tube rows of said tube bundle thus defining an initial position of said lance.

18. The apparatus of claim 17, wherein:

said predetermined row of tubes of said tube bundle is an outermost row of tubes;

said predetermined space between adjacent tube rows is a space between said outermost row of tubes and an adjacent row of tubes; and said first predetermined distance exceeds said second predetermined distance by the sum of one-half the diameter of said tubes plus one-half the spacing between tube rows.

19. The apparatus of claim 17, further comprising:

holder means, attached to said frame, for slidably receiving a portion of said lance forward of said lance carrier, said holder means including alignment rod opening means for slidably receiving said alignment rod in parallel relationship to said lance.

20. The apparatus of claim 19, wherein:

said holder means include first and second spaced plates, and said alignment rod opening means includes first and second spaced rod openings disposed through said first and second plates, respectively.

* * * * *